United States Patent [19]

Blyton

[11] 4,147,304

[45] Apr. 3, 1979

[54] RAILROAD CROSSING AND PROCESS FOR FABRICATION THEREOF

[76] Inventor: Benjamin G. Blyton, 5391 Paris Pike, Lexington, Ky. 40511

[21] Appl. No.: 793,147

[22] Filed: May 23, 1977

[51] Int. Cl.[2] ..... E01C 9/04

[52] U.S. Cl. ..... 238/8; 29/527.1

[58] Field of Search ..... 238/2, 3, 5, 6, 7, 8, 238/9, 283, 382; 29/527.1

[56] References Cited

U.S. PATENT DOCUMENTS

| | | | |
|---|---|---|---|
| 1,364,036 | 12/1920 | Clark | 238/9 |
| 1,771,079 | 7/1930 | Fischer | 238/9 |
| 3,469,783 | 9/1969 | Uralli et al. | 238/8 |
| 3,892,356 | 7/1975 | Harmon | 238/8 |
| 3,955,761 | 5/1976 | Szarka et al. | 238/8 |

FOREIGN PATENT DOCUMENTS

| | | | |
|---|---|---|---|
| 171856 | 12/1951 | Austria | 238/8 |

OTHER PUBLICATIONS

McCue, "Breakthrough to New Respectability", *Railway Track & Structures,* May, 1976, pp. 14–20.

*Primary Examiner*—Francis S. Husar
*Assistant Examiner*—Randolph A. Reese

[57] ABSTRACT

This invention relates to concrete railroad crossing and a process of constructing such railroad crossings which are essentially isolated from all moving parts of the rail system through the employment of compressible foam material to separate the surface of the rails, ties, and other track handware normally in direct contact with a concrete crossing. The crossing is supported on the sub-grade between the rail ties.

2 Claims, 2 Drawing Figures

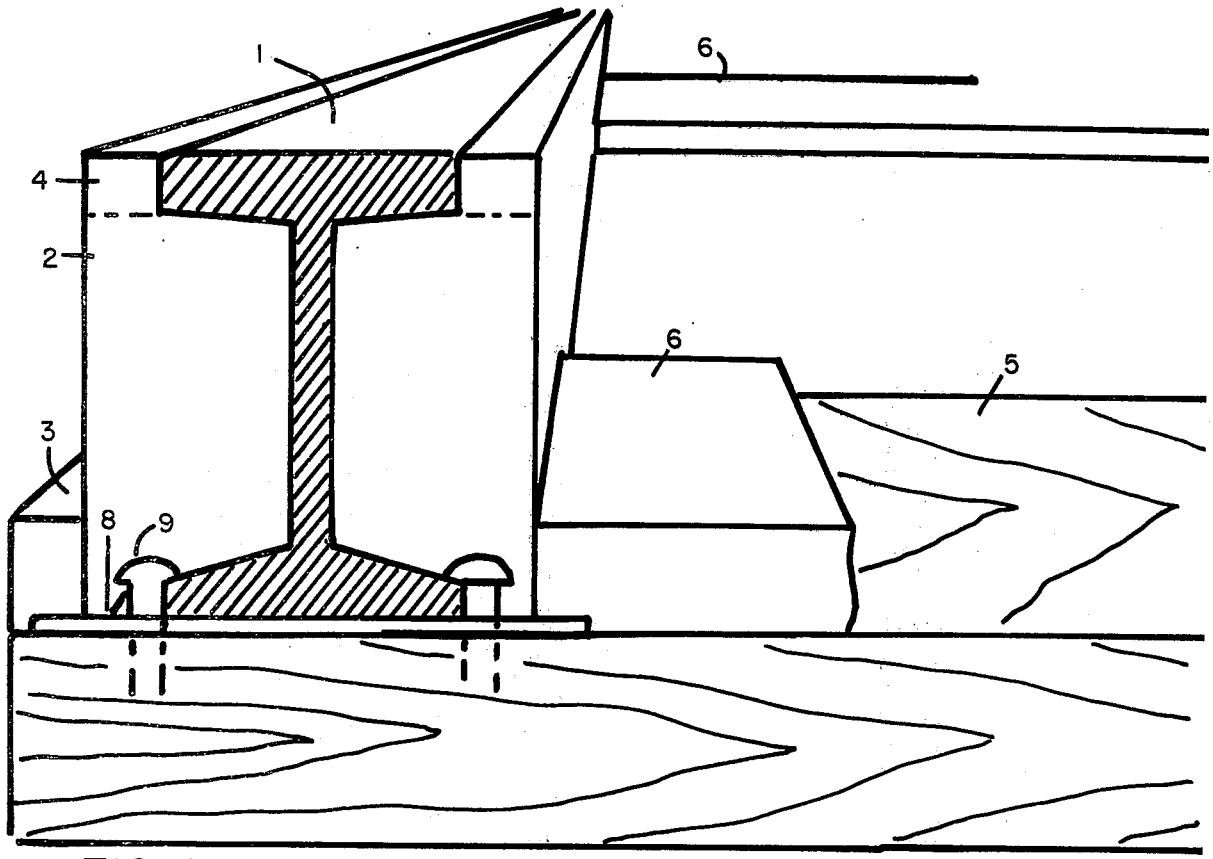
FIG. 1
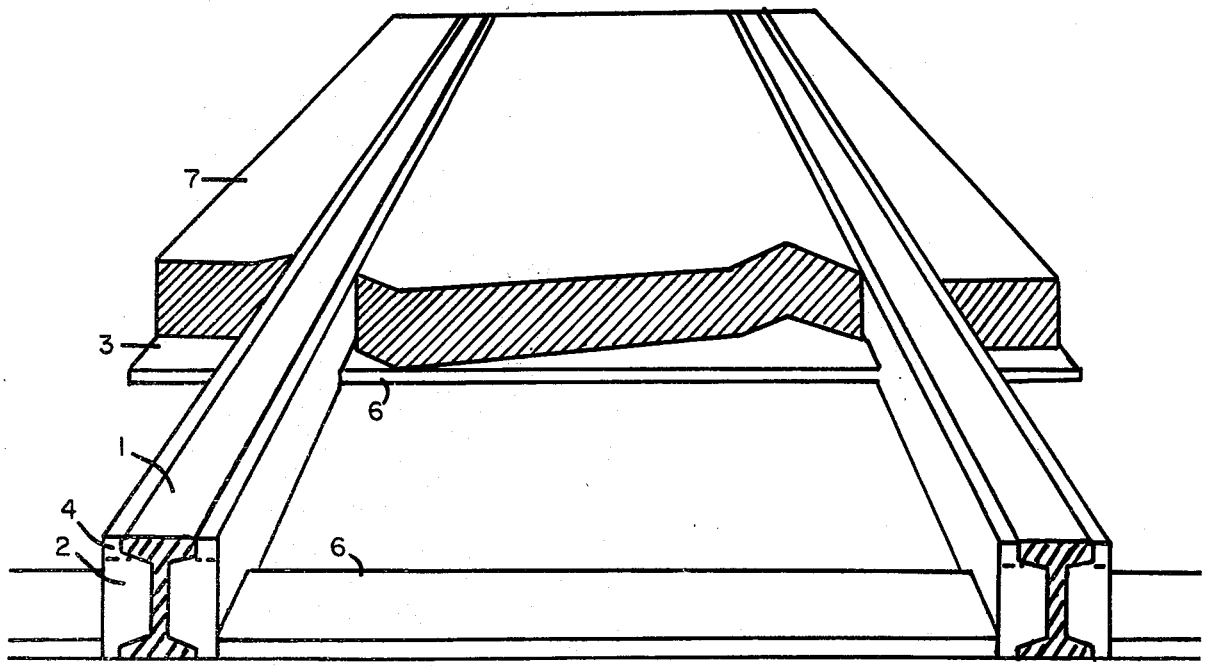

RAILROAD CROSSING AND PROCESS FOR FABRICATION THEREOF

The following relevant patents have been located; U.S. Pat. Nos. 1,659,730 Gerhard, 2,017,336 Alexander, 2,067,037 Alexander, 2,950,057 Speer, 3,141,614 Alsenz et. al. These patents teach the use of concrete for railroad crossings. Alexander (2,017,336) provides spacing members for the rails. Speer (2,950,057) provides elongated resilient rubber strips in the space where the flange of the railroad wheel flange passes. Also, U.S. Pat. No. 3,341,123 isolates rails from a precast concrete slab in which the slab is supported by the rail ties and bags of grout. No references were found in which the railroad crossing was not, in some part, supported by the rails or ties.

By installing compressible members in the rail flangeways and across the rail ties, all moving parts of a rail system are effectively isolated so as to allow a poured-in-place concrete crossing to be constructed, without disruption of rail traffic during cure of the concrete, and eliminate the mechanical damage and interactions normally associated with the movement of the rail system, hereafter known generally as the rail, mechanical connections, rail shoes, spikes, and ties. The crossing is supported solely on the land area between the ties. Further and additional objects of this invention will become apparent upon reading of the detailed description and claims.

FIG. 1 is a front cross sectional view of the rail flangeway inserts.

FIG. 2 is a perspective view of the installed crossing.

A persistent difficulty in maintaining a sound railroad crossing arises from the destructive effects associated with the movement of the rail system against the crossing. Especially damaging interactions occur between the crossing, rail ties and rail joints. A concrete crossing minimizes strain damage imparted from moving ties (owing to the strength of the concrete) but conversely may cause destruction of the ties if they are restricted from following the same movement of the attached rails. The preservation of the overall integrity of a crossing and its associated rail system must then, preclude a necessary avoidance of their interactions. One such method is described herein and further imparts such desirable qualities as low cost, minimal installation "downtime," cleanability of the crossing, and reduced maintenance. The embodiment of this invention utilizes a compressible member, such as polyethylene or polyurethane foam to totally isolate all moving parts of the rail system. Referring to FIG. 1, the compressible material (2) (4), extends along both sides of the rail and encompasses the rail joints, shoes (8), and spikes (9). Compressible material (3) (6), is laid over the rail ties (5). I have found that a two pound density foam is well suited to rail flangeway installation. It should be noted that two pound density foamed polyethylene possesses a compressive strength greater than the force exerted by the weight of the concrete fill and thereby poses no threat to the operative principle of the invention. This can be temporarily secured to the rail (1) by employing contact cement. Securement of the foam to the rail tie is easily accomplished with the same cement or finishing nails depending upon the condition of the ties. The land area between the ties should include compacted pea gravel or other such material so as to provide adequate water drainage and support firmness for the crossing. Additionally, it is apparent that the supporting grade need not be limited to gravel or granular material, but might include spaced pilings or a solid bed, depending on the condition of the subgrade and ties. The rail bed should be coplanar with the upper tie surface without the compressible material. Because the crossing is physically isolated (in the sense that the compressible material need impart no load bearing qualities to the cured concrete crossing) from the rail system, lateral movement of the crossing may be prevented by "keying" it to the gravel bed. This involves removing portions of the gravel below the top grade of the ties so that, for example, the slot between every fourth and fifth tie becomes a keyway. It is obvious that other methods of securement are possible, such as anchored hitches, etc. Wire mesh or reinforcement bars are generally added to give strength to the cured concrete. It has been the experience of the inventor that the concrete may be poured in place and normal rail traffic allowed within ten minutes after screeding and finishing. This was accomplished on a rail system wherein the rail traffic caused vertical rail deflections of approximately three quarters of an inch at a mechanical joint surrounded by the new uncured concrete. There was no indication of any stress or strain being imparted to the concrete crossing. It subsequently became apparent that continuous sections longer than fifty feet can be poured without the lateral keying control or expansion jointing. It has also been observed that the pumping of the rails and ties produces no disruptive displacement of underlying ballast. This would be expected due to the fact that the primary motion of the rail system is constrained to vertical forces acting on the supporting ballast and unaccompanied by deflecting motions capable of overcoming the "compactness" of the ballast. Additionally, it was determined that the compressible material aided the drainage of the crossing and prevented ice accumulations by the elimination of voids. Referring to FIG. 2, it can be seen that compressible member (2) fills the entire rail flangeway. The top portion (2) contains a laminated strip (4), which is replaceable. An important function of the laminated strip is to provide a seal against external debris. This is especially important at food manufacturing plants. It is obvious that strip (4) is not a requirement to the operative principle of the process and other modifications may be equally suited. It should be understood that modifications and variations as well as the substitution of equivalent parts and elements for those shown and disclosed herein may be made without departing from the broader scope of the invention as set forth in the appended claims. The specification and drawings are to be regarded in an illustrative rather than a restrictive sense.

Having described my invention, what I claim is new and unique and desire to secure by Letters Patent of the United States, to wit;

1. A method of constructing a concrete roadway crossing for a railroad comprising the steps of, installing on both sides of each rail a layer of polyethylene or polyurethane compressible foam material having a minimal two pound foam density along the rail flangeways, rail ties, and track hardware, so as to fully cover those portions thereof normally exposed to direct contact with the concrete crossing, said layer precluding direct contact between the concrete of said concrete crossing and the rails and ties, leveling the rail bed so that the land area between the ties is coplanar with the top surface of the tie, pouring concrete over both the ties and the rail bed therebetween in the area defined by the rails and in the area defined by the rails and adjacent roadway, said concrete making direct contact with the land area between the ties and the layer of compressible foam material, allowing the concrete crossing thus constructed and being supported only on the land area between the ties to harden to traffic bearing strength.

2. A railroad grade crossing consisting of;

A. A railroad crossing base or sub-grade,

B. Superimposed on the base, a set of rails, ties, and track hardware which secure said rails to said ties, C. A compressible foam material covering the entire top surfaces of all rail ties and covering the entire rail flangeways, including said track hardware and, D. Paving material constituting the upper surface of said grade crossing, said paving material positioned over the compressible foam and supported solely by the sub-grade between the ties.

* * * * *